US006220221B1

(12) United States Patent
Flinspach et al.

(10) Patent No.: US 6,220,221 B1
(45) Date of Patent: Apr. 24, 2001

(54) METHOD FOR AVOIDING BUCKING OSCILLATIONS DURING ACCELERATION OF VEHICLES

(75) Inventors: Roland Flinspach, Wiernsheim; Andreas Haller, Stuttgart; Franz Moser, Hochdorf, all of (DE)

(73) Assignee: DaimlerChrysler AG, Stuttgart-Mohringen (DE)

( * ) Notice: Subject to any disclaimer, the term of this patent is extended or adjusted under 35 U.S.C. 154(b) by 0 days.

(21) Appl. No.: 09/302,124

(22) Filed: Apr. 29, 1999

(30) Foreign Application Priority Data

Apr. 29, 1998 (DE) ..... 198 19 050

(51) Int. Cl.[7] ..... F02D 31/00
(52) U.S. Cl. ..... 123/370; 123/406.5; 123/492
(58) Field of Search ..... 123/492, 493, 123/682, 406.25, 406.46, 406.5, 370, 371, 399

(56) References Cited

U.S. PATENT DOCUMENTS 4,543,933 * 10/1985 Kessler et al. ..... 123/361
4,844,026 * 7/1989 Tomisawa ..... 123/406.25
4,919,098 * 4/1990 Shimada et al. ..... 123/406.46
5,070,841 * 12/1991 Fujimoto et al. ..... 123/406.46
5,101,786 * 4/1992 Kamio et al. ..... 123/492
5,522,366 * 6/1996 Konno et al. ..... 123/492
5,532,929 7/1996 Hattori et al. ..... 364/431.07

FOREIGN PATENT DOCUMENTS

3738719 C2 11/1987 (DE) .
4013943 C2 4/1990 (DE) .
42 02 407 A1 1/1992 (DE) .
42 23 520 A1 7/1992 (DE) .
43 12 336 A1 4/1993 (DE) .
79371 9/1991 (JP) .
141375 11/1997 (JP) .
40045 7/1998 (JP) .

* cited by examiner

*Primary Examiner*—Erick Solis
(74) *Attorney, Agent, or Firm*—Roland A. Fuller, III

(57) ABSTRACT

In a method to avoid bucking oscillations during acceleration of vehicles, the engine torque is varied.

To reliably prevent bucking oscillations without adversely affecting the acceleration behavior and exhaust behavior, it is proposed that during operation of the gas pedal, the engine torque be varied according to a stipulated engine torque curve between a lower torque value and an upper torque value, in which the engine torque curve has a local maximum adjacent to the lower torque value and has a local minimum between the local maximum and the upper torque value.

20 Claims, 1 Drawing Sheet

METHOD FOR AVOIDING BUCKING OSCILLATIONS DURING ACCELERATION OF VEHICLES

BACKGROUND

Bucking oscillations are vehicle longitudinal oscillations produced by energy introduction into the oscillation system engine-drive train-body, especially during acceleration of the vehicle. The engine torque is transferred via a flywheel to the drive train, which acts as a torsion spring and initially must be distorted under the influence of the engine torque. If this occurs by a rapid torque buildup, because of the kinetic energy stored in the flywheel, overshooting of the flywheel occurs, which manifests itself in the aforementioned category of bucking oscillations.

Prevention of bucking oscillations is known from DE 40 13 943 C2, in which the engine torque is influenced by controlled fuel injection as a function of the oscillation time of the bucking oscillation. An attempt is made to avoid longitudinal movements caused by bucking by a deliberate reduction or increase of engine torque in the corresponding phases of the bucking oscillation.

The method known from DE 40 13 943 C2 presumes that the oscillation period of the bucking oscillation is initially recorded. The engine torque curve is then influenced via fuel injection in counterphase to the bucking oscillation. This procedure has the drawback that, to record the oscillation period, the first bucking oscillation having the highest amplitude must be waited for before the bucking-attenuating measures can be taken, so that driving comfort is not improved to the desired extent. Another shortcoming is that the torque curve is countercontrolled to the bucking movement, which makes necessary rapid, consecutive buildup and reduction of the engine torque. This multiple torque change adversely affects the basic acceleration of the vehicle and causes a deterioration in exhaust behavior of the internal combustion engine.

A method to prevent interfering load change impacts in a vehicle internal combustion engine is also known from DE 37 38 719 C2. According to the method known from this document, to avoid vehicle longitudinal oscillations, the adjustment command given by the driver via the gas pedal is to be transferred in delayed fashion for a power control element, in which the delay is limited to the range of the zero passage of the torque curve. During abrupt load changes, the driver's desires are transferred with a delay to the engine control.

The method known from DE 37 38 719 C2 is only suitable to minimize load change impacts because of intervention in the region of the zero passage of the torque curve, but not to avoid bucking oscillations that ordinarily occur in the exclusively positive or exclusively negative torque region without zero passage.

The underlying problem of the invention is to reliably prevent bucking oscillations without adversely affecting the acceleration behavior and exhaust behavior.

This problem is solved according to the invention with the features of claim 1.

SUMMARY

The torque curve is divided into two sections between the lower torque value and the upper torque value: a first section connected with the lower torque value with the local maximum and a second section adjacent to the upper torque value with the local minimum. In the first section, the drive train, starting from the lower torque value, is initially prestressed at the local maximum with a defined torque pulse or a first step. In the second section, the torque drops to the local minimum. The engine torque is further reduced during oscillation of the drive train from the local torque maximum to the local torque minimum; because of inertia of the drive train, this is prestressed, despite the already reduced torque. At the reversal point of the oscillation excursion, the engine torque reaches the upper torque value from the local minimum. The drive train is statically prestressed because of this at the moment of application of the upper torque value, and no or only strongly reduced bucking oscillations occur.

Another advantage is that acceleration of the vehicle is built up almost the same as during a torque step function, so that high agility is reached, but without the bucking oscillations that occur in a step function.

In an expedient modification the time interval between the lower torque value (in the case of a positive vehicle acceleration, the initial value) and the upper torque value (the target value) amounts to about ¼ to ½ of the oscillation time of the bucking oscillation, so that optimal oscillation compensation is achieved. This interval varies as a function of the selected function of the local maximum and is divided into a period of maximum and a period of minimum engine torque. If a rectangular pulse in the approximate form of a Dirac pulse is chosen as oscillation excitation to prestress the drive train as local maximum, the entire time interval for the maximum and the minimum can be shortened to ¼ of the oscillation time of the bucking oscillation. This curve has the advantage that the rise from the lower to the upper torque value is achieved in the shortest possible time, while avoiding bucking oscillations.

The local minimum connected to the local maximum can also have a rectangular curve. The amplitude can have a small value greater than zero, or can also be equal to zero.

If the time interval for the local maximum is increased, the amplitude of the maximum is preferably simultaneously reduced. With equal level of the local minimum, the duration of the minimum must be simultaneously short. Overall, the entire interval for the maximum and the minimum is increased to a maximum to half the oscillation time of the bucking oscillation. This variant has the advantage that it is sufficient to apply a lower level for the torque maximum; the bucking oscillations can nevertheless be equalized.

If the interval for the local maximum with the same amplitude is increased, the amplitude and time of the local minimum are reduced.

Instead of a rectangular function, a continuous function can also be chosen for the torque curve. It is particularly advantageous to provide a sloped curve with an intermediate point minimum between the maximum and the minimum and between the minimum and the upper torque value. The two slopes can be designed with different steepness, in which the slope between the local minimum and the upper torque value is steeper than the slope between the local maximum and the local minimum.

In the continuous curve no torque jumps occur; it can therefore be easily implemented technically.

Additional advantages and expedient variants can be gathered from the other claims, the description of the figure and the drawings. In the drawings:

DETAILED DESCRIPTION

The engine torque curves, depicted as a finction of time in FIGS. 1 to 4, are suitable for acceleration of a vehicle with an internal combustion engine, free of bucking, with simultaneously high agility, i.e., spontaneous, delay-free response and rapid application of the target torque. The torque curves can be traversed from left to right during acceleration of the vehicle, in which the torque curve is increased, starting from a lower engine torque $M_u$, which represents the initial torque, to an upper engine torque $M_o$, which represents the target torque. During vehicle deceleration, the torque curves will run in the opposite direction, from right to left, starting from the upper engine torque $M_o$ to the lower engine torque $M_u$.

The graphs are described below on the example of an acceleration process.

Figure 1:
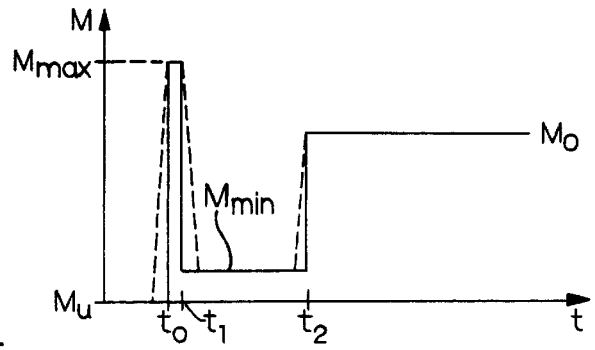
FIG. 1 to FIG. 3 show different rectangular torque curves.

According to FIG. 1, the acceleration process begins at a lower engine torque $M_u$ equal to zero and rises abruptly at time $t_0$ to a local maximum $M_{max}$, falls abruptly at time $t_1$ to a local minimum $M_{min}$, remains at this level to time $t_2$ and finally rises abruptly to the level of the upper engine torque $M_o$.

FIG. 1 represents an extreme case, in which the torque curve in the region of the local maximum assumes roughly the shape of a Dirac pulse, so that the duration of the pulse is very small between $t_0$ and $t_1$. Since the pulse is limited by the maximum possible engine torque, the local maximum $M_{max}$ will assume roughly the shape of a rectangular function with limited amplitude and limited duration.

The lower initial torque $M_u$ can be equal to zero, but also assume a value deviating from zero, especially be smaller than zero, which in this case corresponds to a load change from thrust operation to traction operation. The level of the local minimum $M_{min}$ can be zero or greater than zero. The level of the upper target torque $M_o$ is stipulated by the driver via the gas pedal position and is limited by the maximum possible engine torque. The level of the local maximum $M_{max}$ can be greater than the upper target torque $M_o$, if the latter is smaller than the maximum possible engine torque.

Because of the delayed response behavior of individual system components, according to the dashed graph, slopes with a high gradient can be set between the lower torque $M_u$ and the local maximum $M_{max}$, between the local maximum $M_{max}$ and the local minimum $M_{min}$, as well as between the local minimum $M_{min}$ and the upper torque $M_o$. A sloped curve is expediently stipulated from the outset, so that a continuous torque curve is obtained.

The time interval $t_0$ to $t_2$ between the lower engine torque $M_u$ from the beginning of the local maximum to achievement of the upper engine torque $M_o$ is adjusted to the oscillation time of the bucking oscillation and, with a rectangular torque curve, expediently lies between ¼ and ½ of the oscillation time of the bucking oscillation. Because of this, the drive train is prestressed by the local maximum in the torque curve and, at the reversal point of the oscillation excursion, the upper engine torque $M_o$ is reached, so that the bucking oscillations are compensated.

If, as shown in FIG. 1, a rectangular pulse of limited duration and high amplitude is stipulated as local maximum, a shortest possible time interval $t_0$ to $t_2$ can be set for the local maximum and the local minimum of a total of ¼ of the oscillation time of the bucking oscillation. The transition from the lower engine torque $M_u$ to the upper engine torque $M_o$occurs in the shortest possible time.

The time interval $t_0$ to $t_2$ is increased when the amplitude of the rectangular local maximum is reduced and extends over a longer period $t_0$ to $t_1$. The level and duration $t_1$ to $t_2$ of the local minimum is simultaneously changed because of this.

On the other hand, the level of the local maximum and the level of the local minimum can also be fixed, from which the time intervals for the local maximum and the local minimum are necessarily obtained.

Figure 2:
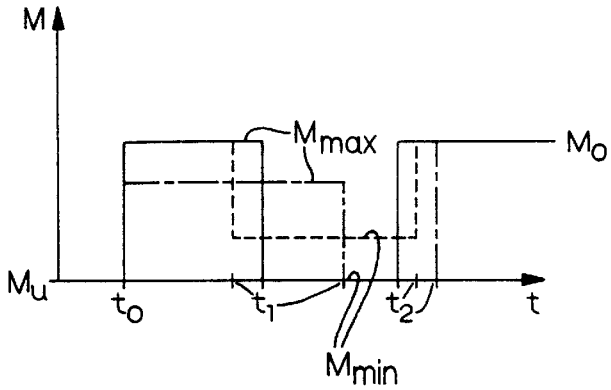

FIG. 2 shows a modified curve for a rectangular torque function. According to the function in FIG. 2 plotted with the solid line, the time interval for the local maximum and the local minimum amounts, in each case, to about ⅙ of the oscillation time of the bucking oscillation, so that the entire time interval $t_0$ to $t_2$ for the local maximum and local minimum lasts about ⅓ of the oscillation time of the bucking oscillation, in which these ratios apply, in particular, for the condition in which the local maximum $M_{max}$ has the same torque level as the upper torque level $M_o$.

According to the dash-dot line in FIG. 2, the time interval to for the local maximum $M_{max}$ is lengthened with simultaneously smaller amplitude. The duration of the local minimum between $t_1$ and $t_2$ is then shortened with the same height of the local minimum. The entire interval from $t_0$ to $t_2$ for the local maximum and minimum is increased.

As graphed with the dashed line in FIG. 2, the local minimum can be increased, starting from a value greater than zero. The time interval $t_1$ to $t_0$ is then increased. The upper torque value $M_o$ is reached later and the time interval $t_0$ to $t_1$ is reduced. The lower engine torque $M_u$ lies at zero in the practical example shown in FIG. 2.

Figure 3:
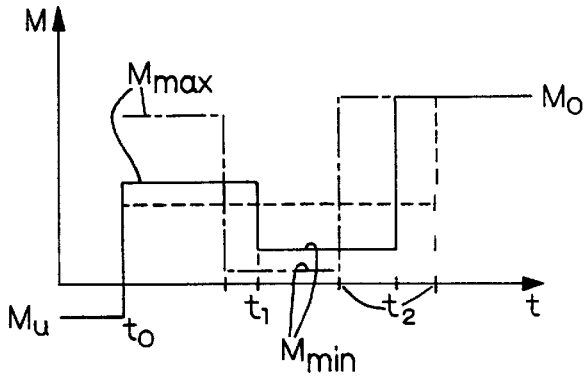

FIG. 3 shows the engine torque in another variant with a rectangular curve, in which a load change occurs from thrust operation to traction operation. The lower engine torque $M_u$ assumes a value smaller than zero and, in this state, the engine is in thrust operation. At time $t_0$, the engine torque rises to the local maximum $M_{max}$, which lies below the level of the upper engine torque $M_o$ (solid line). At time $t_1$, the torque drops to the local minimum $M_{min}$ larger than zero, remains at this level, and then rises at time $t_2$ to the upper engine torque $M_o$.

The torque difference between the local maximum $M_{max}$ and the local minimum $M_{min}$ can optionally be sharply reduced. As shown with the dashed line in FIG. 3, the local minimum can have the same level as the local maximum, so that a two-stage step finction is produced for the torque curve between the lower and upper engine torque. In this variant the time $t_2$ marking the end of the local minimum is shifted rearward.

Another variant is plotted in FIG. 3 with a dash-dot line. The local maximum $M_{max}$ lies at a comparatively higher level than in the solid line function and drops at time $t_1$ earlier to the local minimum $M_{min}$, whose level lies below the comparable level of the solid line finction. The interval $t_1$ to $t_2$ for the duration of the local minimum is shortened, and the upper torque value $M_o$ is reached earlier.

Figure 4:
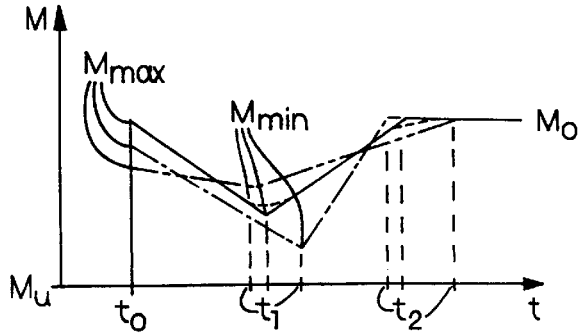
FIG. 4 shows a sloped torque curve.

FIG. 4 shows a sloped torque curve between the point-like local maximum $M_{max}$ and the also point-like local minimum $M_{min}$, as well as between the local minimum and the upper torque value $M_o$, so that a V-shaped curve is obtained between $M_{max}$ and $M_o$. The local maximum $M_{max}$ lies in the function plotted with the solid line at roughly the level of the upper torque value $M_o$, the local minimum $M_{min}$ has a value greater than zero. The time interval $t_0$ to $t_1$ for the reduction of engine torque from $M_{max}$ to $M_{min}$ is roughly as great as the time interval $t_1$ to $t_2$ for the rise of engine torque from $M_{min}$ to $M_o$.

The local maximum of the dash-dot finction lies slightly below the maximum of the solid line finction and drops to a lower local minimum, which is reached at a later time $t_1$. The sloped rise to the upper torque value $M_o$ occurs with a larger gradient, in which the upper torque value $M_o$ is reached at an earlier time $t_2$, in comparison with the solid line fimction.

According to a variant not shown, the upper torque value can also be reached later with the same parameters as just described.

The torque curve marked with a dash-double dot line begins at the local maximum $M_{max}$, whose level is reduced, and runs in a gently sloping drop to the local minimum $M_{min}$, which is reached at an earlier time $t_1$. The sloped rise to the upper torque value $M_o$ exhibits a larger gradient than the diminishing sloping drop; the upper torque value $M_o$ is reached at a later time $t_2$.

Instead of a point-like local minimum, it can be expedient to provide, in the local minimum, a section of equivalent torque level, so that a roughly trapezoidal curve of the local minimum is obtained.

Both the rectangular and V-shaped torque curves can be fixed by selecting two parameters. In selecting the local minimum and the local maximum, the times $t_1$ and $t_2$ for the end of the local maximum and the local minimum are predetermined within narrow limits. In selecting a torque value for maximum or minimum and a time, the other torque value or the other time are predetermined within narrow limits.

As graphed with the dashed line, it can be expedient to smooth the transitions between the different torque levels, in order to obtain a continuous curve for the engine torque in the first and, optionally, also in the second derivative. The depicted curves can be approximated by polynomials.

According to another advantageous, sawtooth-like variant, the torque curve slopes down from the local maximum to the local minimum and rises abruptly at time $t_2$ to the level of the upper torque value $M_o$. The curve of this function is fixed by parameters $M_{max}$, $M_{min}$ and $t_2$, in which $t_2$ simultaneously marks the beginning and end of the local minimum. If one of the determining parameters is freely chosen, the two other parameters have narrow limits for variation. The greater the gradient of the sloping drop from the maximum to the minimum, the lower the level of the minimum and the earlier time $t_2$ is reached, at which the abrupt rise to the upper torque value $M_o$ occurs.

In addition to the depicted curves, any additional curves can also be used for the engine torque, if the condition is met that the torque initially rises to a local maximum $M_{max}$, starting from a lower torque $M_u$, then drops to a local minimum $M_{min}$ and then rises again to the upper torque $M_o$. These curves can be obtained, for example, from measured points that are optionally smoothed by polynomials.

The torque curves can be calculated in a control and regulation unit and filed in the memories of the control and regulation unit, scanned in discrete steps and fed as control signal to various engine components, via which the engine torque can be influenced. For example, the engine torque can be set via ignition angle adjustment, ignition misfiring, fuel injection, exhaust recirculation or an exhaust turbosupercharger or similar means. It is also possible to set the engine torque via a throttle valve control, in which the control element of the throttle valve is opened abruptly and briefly to generate the local maximum, then closed again for the local minimum and finally opened again to achieve the upper torque value.

What is claimed is:

1. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve in which the engine torque curve has a local maximum adjacent the lower torque curve, in value, a local minimum between the local maximum and the upper torque value, and a time interval between the lower torque value and the upper torque value that is ¼ to ½ of an oscillation time of the bucking oscillations.

2. The method according to claim 1 and further including the step of reducing the amplitude of the local maximum as duration of the local maximum increases.

3. The method according to claim 2 and further including the step of maintaining the amplitude of the local minimum as duration of the local maximum decreases.

4. The method according to claim 3 and further including the step of increasing total time for duration of the local minimum and the local maximum.

5. The method according to claim 4 and further including the step of increasing the amplitude of the local minimum as duration of the local minimum increases.

6. The method according to claim 5 and further including the step of maintaining the amplitude of the local maximum as duration of the local maximum decreases.

7. The method according to claim 6 and further including the step of increasing the total time of duration of the local maximum and the local minimum.

8. The method according to claim 1 wherein the step of varying the torque of an engine according to an engine torque curve includes varying the torque of an engine according to an engine torque curve that slopes and the local minimum is point-like.

9. The method according to claim 1 wherein the step of varying the torque of an engine according to an engine torque curve includes varying the torque of an engine according to an engine torque curve that slopes and the local minimum has a section of constant torque.

10. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and the local maximum having a duration that is a maximum of ¼ of an oscillation time of the bucking oscillations.

11. The method according to claim 10 wherein the step of varying the torque of an engine according to an engine torque curve includes varying the torque of an engine according to an engine torque curve that slopes and the local minimum is point-like.

12. The method according to claim 10 wherein the step of varying the torque of an engine according to an engine torque curve includes varying the torque of an engine according to an engine torque curve that slopes and the local minimum has a section of constant torque.

13. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and the local minimum having a duration that is a maximum of ¼ of an oscillation time of the bucking oscillations.

14. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and a time interval between the local maximum and the local minimum that is equal to a time interval between the local minimum and the upper torque value.

15. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and reducing the amplitude of the local maximum as duration of the local maximum increases.

16. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and that is abrupt between the local minimum and the upper torque value.

17. The method according to claim 16 wherein the step of varying the torque of an engine according to an engine torque curve that is abrupt between the local minimum and the upper torque value includes varying the torque of an engine according to an engine torque curve that is abrupt between the local minimum and the upper torque value and the local minimum is point-like.

18. The method according to claim 16 wherein the step of varying the torque of an engine according to an engine torque curve that is abrupt between the local minimum and the upper torque value includes varying the torque of an engine according to an engine torque curve that is abrupt between the local minimum and the upper torque value and the local minimum has a section of constant torque.

19. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and that, at least in sections, is a rectangular function.

20. A method for avoiding bucking oscillations during acceleration of a motor vehicle, comprising the step of varying, during operation of a gas pedal of the vehicle, the torque of an engine of the motor vehicle according to an engine torque curve between a lower torque value and an upper torque value of the engine torque curve, in which the engine torque curve has a local maximum adjacent the lower torque value, a local minimum between the local maximum and the upper torque value, and that, at least in sections, is a rectangular function with the local maximum and local minimum each forming a roughly rectangular step of the rectangular function.

* * * * *